United States Patent [19]

Hansen

[11] 4,045,938

[45] Sept. 6, 1977

[54] METHOD OF FILLING BARRIER PRESSURE CONTAINER

[75] Inventor: Harold M. Hansen, Westfield, N.J.

[73] Assignee: Barrier Pressure Container, Inc., Tuckahoe, N.Y.

[21] Appl. No.: 670,817

[22] Filed: Mar. 26, 1976

[51] Int. Cl.[2] ..... B65B 31/09; B67D 5/38; B67D 1/04

[52] U.S. Cl. ..... 53/22 R; 53/36; 53/37; 141/327; 222/389; 222/402.22

[58] Field of Search ..... 141/2, 326, 327; 251/349-354; 53/37, 88, 22 R, 36; 222/386, 387, 389, 402.1, 402.21, 402.22, 402.23, 402.24, 402.25

[56] References Cited

U.S. PATENT DOCUMENTS

| | | | |
|---|---|---|---|
| 3,048,307 | 8/1962 | Michel | 222/402.22 |
| 3,128,922 | 4/1964 | Kuster | 222/389 |
| 3,245,591 | 4/1966 | Knewsel et al. | 222/389 |
| 3,377,003 | 4/1968 | Bacon et al. | 222/386 |
| 3,581,941 | 6/1971 | Bruce et al. | 222/402.22 X |
| 3,901,416 | 8/1975 | Schultz | 222/389 |

*Primary Examiner*—Robert B. Reeves
*Assistant Examiner*—David A. Scherbel
*Attorney, Agent, or Firm*—A. Yates Dowell, Jr.

[57] ABSTRACT

A barrier pressure container apparatus for dispensing viscous materials and a method of filling such container. The apparatus includes a generally cylindrical container having concave ends with a piston located between the same and having a viscous material on one side of the piston and fluid under pressure on the opposite side thereof. A dispensing valve is mounted in the top of the container so that material is dispensed by the pressure below the piston when the valve is open.

1 Claim, 5 Drawing Figures

METHOD OF FILLING BARRIER PRESSURE CONTAINER

BACKGROUND OF THE INVENTION

1. Field of the Invention

This invention relates generally to containers of various kinds which contain flowable material under pressure and are adapted to be dispensed when a valve is operated and relates particularly to a container having a concave or inwardly extending surface at both ends of a generally cylindrical body as well as to the method of filling the container with flowable material in a manner to substantially exclude air from the container when the top is placed thereon.

2. Description of the Prior Art

Heretofore pressurized dispensing containers have normally been separated into three groups. The first group includes aerosol containers in which the product to be dispensed is usually mixed with a fluorocarbon material having a low boiling point so that when the valve is opened the product and the carrier are both dispensed from the container. The second group of product dispensing containers has included a piston located within the container with the product to be dispensed on one side of the piston and a gas under pressure on the opposite side of the piston in a sealed chamber. The gas under pressure normally is air and when the valve is opened, the pressure on the product is relieved and the gas forces the piston against the lower portion of the product to cause the product to be discharged through the valve. The third group of containers for dispensing material under pressure includes containers having a flexible collapsible bag in which the material to be dispensed is located and fluid under pressure substantially completely surrounds the bag so that when the valve is opened the bag is collapsed by the fluid under pressure and the material within the bag is forced outwardly through the nozzle.

The present invention is concerned only with the type of dispenser having a generally cylindrical body with a piston movably mounted therein. This type of container normally requires that substantially all of the air be excluded therefrom before the container is used, otherwise a pocket of air collects adjacent to the valve and when the valve is opened the first time the discharge of air expels a small quantity of product at a high velocity and causes the product to spatter over a wide area.

Some representative art of piston type dispensing containers are the patents to Kaye et al. U.S. Pat. No. 2,809,774; Mahon et al. U.S. Pat. No. 2,895,650; Hoffman U.S. Pat. No. 3,022,923; Hein U.S. Pat. No. 3,099,370; Katz et al. U.S. Pat. No. 3,272,387; Towns U.S. Pat. No. 3,381,863; Knight et al. U.S. Pat. No. 3,415,425; Schultz U.S. Pat. Nos. 3,827,607 and 3,901,416; and Scheindel U.S. Pat. No. 3,897,672.

SUMMARY OF THE INVENTION

The present invention is embodied in a barrier pressure container having a dispensing valve permanently mounted at one end of a generally cylindrical body and a slidably mounted piston therein as well as the method of filling such container in a manner to exclude air from the compartment in which the product to be dispensed is contained. The container normally is of a three-piece construction and includes a generally cylindrical body having a concave bottom member attached to one end of the body, and a concave top member having a dispensing valve mounted thereon attached to the opposite end of the body. The bottom member is normally provided with a sealing compound to form an airtight connection which prevents the flow of air in either direction, and the top member may or may not be sealed.

When the container is to be charged with a flowable viscous material, the piston is inserted into the body of the container either before or after the bottom member is sealed to the container body. Thereafter the flowable material is introduced into the container body under atmospheric pressure until the material reaches a predetermined level spaced from the end of the container body. Then the concave top member is placed on the container and due to the concavity of such top member the central portion thereof engages the material before the peripheral portions engage the side wall of the container and therefore the material within the container is forced outwardly and upwardly to expel substantially all of the air from the container before the peripheral portions of the top member engage the side walls of the body.

It is an object of the invention to provide a method of filling a barrier pressure container under atmospheric pressure with a product to be dispensed in a manner to exclude substantially all free air from the container.

It is another object of the invention to provide a barrier pressure container having a dispensing valve which permits substantially even flow of product from the container during the entire time of dispensing of the product.

DESCRIPTION OF THE PREFERRED EMBODIMENT

Figure 1:
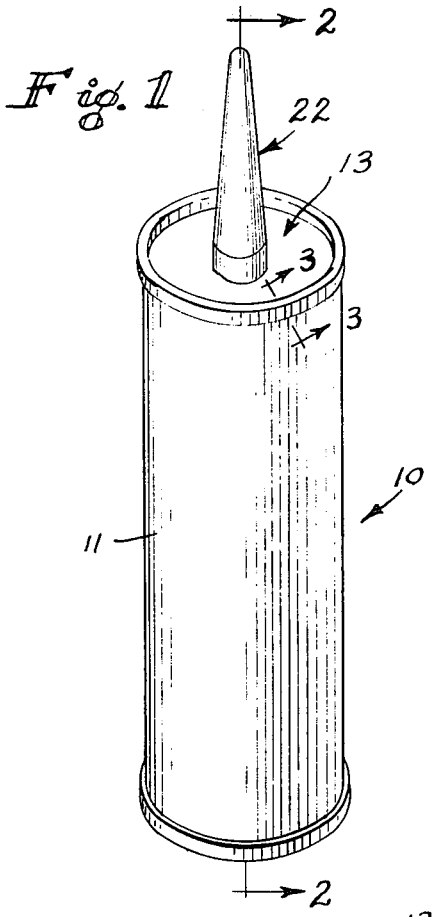
FIG. 1 is a perspective of the container of the present invention.
Figure 2:
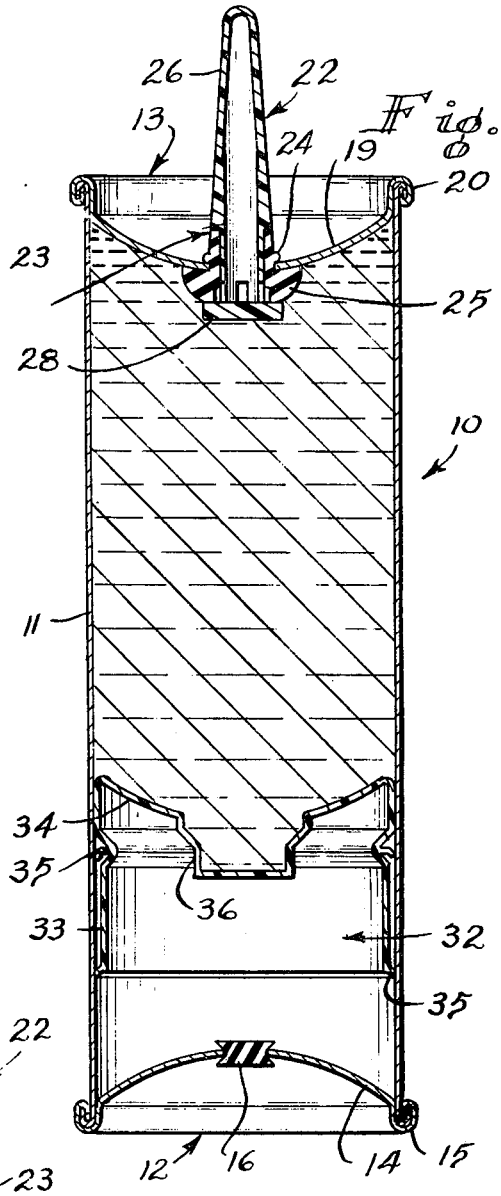
FIG. 2 is an enlarged section taken on the line 2—2 of FIG. 1.

With continued reference to the drawing, a three-piece barrier pressure container 10 is provided having a generally cylindrical body 11 with a bottom member 12 at one end and a top member 13 at the opposite end. The body 11 may be constructed of sheet metal which initially is flat and is rolled into a cylindrical configuration with the overlapping edges joined together in any desired manner, as by solder, welding, or the like. If desired, the body could be extruded in a thin walled tubular shape. It is contemplated that the body could be made in a deep drawing operation in which case the bottom member 12 would be an integral part of the body.

For purposes of illustration, the container is provided with three pieces in which the bottom member 12 has a central portion defining an upwardly curved concave wall 14 located within the body, and the periphery of such bottom member is provided with a flange 15 which is crimped, welded, or otherwise attached to one end of the body 11. The concave wall 14 resists any bowing outwardly of the bottom wall when the contents of the container are pressurized. Before assembly the flange 15 of the bottom member ordinarily is provided with a conventional resilient sealing material (not shown) so that the connection between the bottom member 12 and the body 11 is airtight. The central portion of the concave wall 14 is provided with an opening in which a resilient plug 16 is mounted so that a fluid under pressure can be introduced into the container in a manner which will be described later.

The top member 13 includes a central inwardly curved concave wall 19 and an outer peripheral flange 20 which is adapted to be crimped, welded, or otherwise attached to the upper end of the body 11. The flange 20 may or may not have a conventional sealing compound, depending upon the material within the container. When the container is to be used for dispensing viscous semi-liquid food products, such as cheese or the like, or a cleansing product such as toothpaste, the top may be provided with a sealing compound to prevent the introduction of bacteria. When the container is to be used for dispensing viscous materials such as caulking compound, putty, plaster, or the like, a sealing compound is not required for the top member 13.

The central portion of the concave wall 19 is provided with an opening 21 in which a valve member 22 is positioned. The valve member is of conventional construction and ordinarily includes a resilient grommet 23 of rubber or the like, having a bead or small flange 24 spaced from a shoulder or tapered flange 25 by a distance substantially corresponding to the thickness of the material of the top member 13. A valve stem 26, which usually is made of thermoplastic material, is carried by the grommet 23, and such stem normally has a plurality of openings 27 located within the large flange 25 of the grommet and adjacent to the base 28 which is an integral part of the valve stem 26. Preferably the upper portion of the valve stem is tapered in a generally frusto-conical configuration and initially the upper end of the stem is sealed to prevent accidentally dispensing the material, as well as to exclude air. When the product is to be dispensed, the upper end of the valve stem is cut off with a sharp instrument, such as scissors, a knife, or the like, at any desired location and angle to control the size of the bead of material being dispensed.

Figure 3:
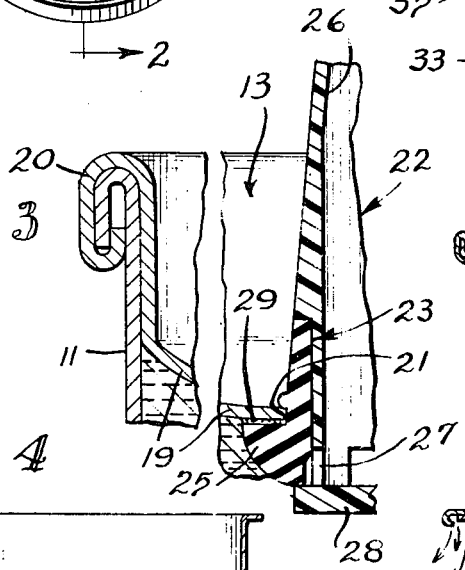
FIG. 3 is an enlarged fragmentary section taken on the line 3—3 of FIG. 1.
Figure 4:
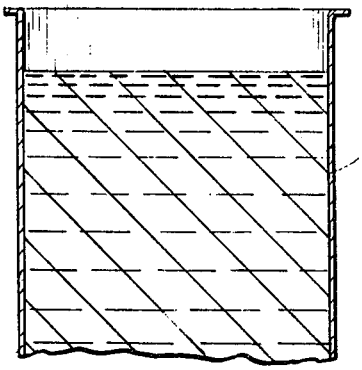
FIG. 4 is a fragmentary section of a container after the product has been introduced and before the top member is applied thereto.
Figure 5:
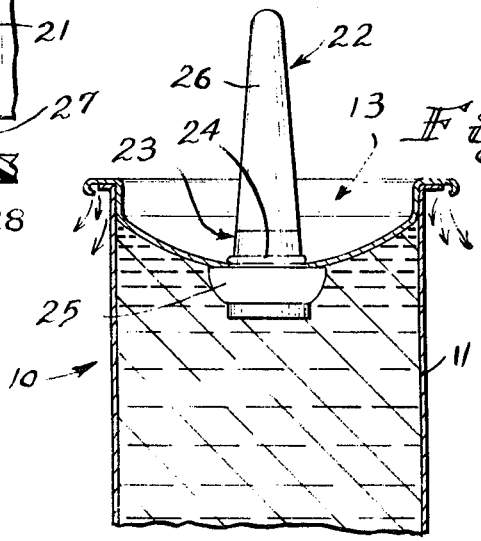
FIG. 5 is a section similar to FIG. 4 illustrating the container after the top member has been placed in position and before the edges are attached.

With particular reference to FIG. 3, the shoulder or large flange 25 of the grommet is provided with a layer of adhesive 29 on its upper surface so that when the valve member 22 is inserted into the opening 21, the bead or small flange 24 is compressed to pass through the opening so that the upper surface of the large flange 25 engages the lower surface of the concave wall 19. Due to the resiliency of the grommet, the adhesive or other bonding agent is pressed against the surface of the concave wall 19 and permitted to set under pressure.

Within the container 10 a piston 32 is provided having a generally cylindrical side wall 33 and an end wall 34. The side wall 33 of the piston may be provided with one or more annular flanges 35 which slidably seal the side wall of the piston to the inner periphery of the body 11. The end wall 34 of the piston preferably is constructed of relatively rigid material so as to retain its shape while applying pressure to the material to be dispensed. The end wall 34 is of a concave configuration substantially complementary to the inner surface of the concave wall 19 of the top member so that substantially all of the material within the container can be discharged. In order to accommodate the large flange 25 of the grommet 23 and the base 28 of the valve member 22, the central portion of the end wall 34 is provided with a recessed wall structure 36 generally complementary to the exterior surfaces of the flange and base of the valve member.

In the operation of the device, the piston 32 is inserted into the body 11, either before or after the bottom member 12 is applied to one end of the body and attached thereto. At this point the container body is placed in a generally vertical position and a mass of viscous flowable material such as soft cheese, toothpaste, caulking compound, or the like is introduced into the open upper end of the body under atmospheric conditions until the flowable material reaches a predetermined level at which time the introduction of the material is interrupted.

Thereafter the top member 13 is positioned above the container body and is moved downwardly generally axially of the body so that the base 28 and the large flange 25 of the valve member 22, as well as the lower surface of the concave wall 19, engage the material and force the material upwardly and outwardly along the concave wall. The upward and outward movement of the material while the top member is being pressed downwardly expels substantially all of the air above the material to be dispensed by the time that the flange 20 of the top member engages the end of the body 11. Then the flange 20 and the upper end of the body 11 are crimped together to close the upper end of the container.

After the container has been closed, the area of the container below the piston 32 is pressurized in any desired manner, as by forcing a hollow needle through the plug 16 and pumping high pressure fluid such as air into the compartment below the piston. Normally the area below the piston is provided with a pressure of approximately 90 psi, although it is contemplated that with some easily flowable materials, such as toothpaste or the like which normally are discharged at a slow rate, a fluid pressure of approximately 60 psi is satisfactory.

When the area below the piston has been pressurized, the piston exerts an upward force against the material to compact such material and in cases where the flange 20 of the top member 13 does not have a sealant, any residual air which has been trapped within the product can leak out through the crimped connection betwen the top member 13 and the upper end of the body 11. The consistancy of the material within the container is sufficiently dense to prevent such material from passing through the connection.

When it is desired to dispense material from the container, the upper end of the valve member 22 is cut off and when the upper end of the valve stem 26 is tilted the lower end thereof and the base 28 are moved away from the large flange 25 so that material is forced through the openings 27 and is discharged through the valve stem 26. During the initial dispensing, the pressure of the material within the container caused by the compressed fluid bears against the lower surface of the large flange 25 to maintain a good seal between the upper surface of the flange and the lower surface of the concave wall 19. However, as the material is being dispensed, the fluid under pressure in the lower portion of the container expands so that the pressure applied to the product is reduced and therefore the pressure applied against the bottom of the large flange 25 likewise is reduced. Normally when most of the product has been dispensed, the pressure within the container is not sufficient to hold the large flange in intimate engagement with the bottom surface of the concave wall 19, at least in the direction of tilting of the valve stem. Therefore the large flange has had a tendency to move away from the concave wall 19 and consequently reduce the size of the opening 27 through which material was being dispensed. The application of the adhesive 29 to the upper surface of the shoulder or large flange bonds such flange to the lower surface of the concave wall 19 to seal the large flange to the concave wall and prevent relative movement therebetween. Since the flange can no longer move, the sides of the dispensing opening 27 remain the same regardless of the pressure being applied to the product.

I claim:

1. The method of filling a barrier pressure container with a flowable viscous product, said container having a generally cylindrical body with a wide mouth open top and a piston located adjacent to the bottom of said body, comprising the steps of: positioning said body along a generally vertical axis, introducing flowable material into said container body through the open top of said body until the material reaches a predetermined level below the open top of said container, inserting a top member having a concave wall and an annular peripheral flange into the open top of said container so that the concave wall engages the material and forces the material upwardly and outwardly to exhaust substantially all of the air above the material from the container without discharging material from the container before the peripheral flange of the top member engages the container, securing the annular flange of the top to said container, and pressurizing the space below the piston to cause the piston to apply pressure against the material within said body.

* * * * *